United States Patent [19]

Krein

[11] Patent Number: 5,059,084

[45] Date of Patent: Oct. 22, 1991

[54] VACUUM APPARATUS FOR INSTALLING A WATER PROOF LINER

[75] Inventor: Reuben Krein, Fort Smith, Ark.

[73] Assignee: BJK Industries, Inc., Fort Smith, Ark.

[21] Appl. No.: 385,243

[22] Filed: Jul. 25, 1989

Related U.S. Application Data

[63] Continuation of Ser. No. 241,770, Sep. 7, 1988, Pat. No. 4,863,339, which is a continuation of Ser. No. 863,093, May 14, 1986, abandoned, which is a continuation-in-part of Ser. No. 733,962, May 14, 1985, Pat. No. 4,671,733, which is a continuation-in-part of Ser. No. 502,696, Jun. 9, 1983, Pat. No. 4,516,906.

[51] Int. Cl.[5] ..... B65D 88/12

[52] U.S. Cl. ..... 414/467; 414/373; 414/572; 220/461; 220/403; 220/404; 222/105

[58] Field of Search ..... 414/786, 572, 373, 293, 414/398, 467; 406/38; 222/105; 220/403, 85 B, 410, 461, 462; 296/37, 39 R

[56] References Cited

U.S. PATENT DOCUMENTS 3,696,952 10/1972 Bodenheimer ..... 414/412 X

FOREIGN PATENT DOCUMENTS 6918892 6/1970 Netherlands ..... 222/105

*Primary Examiner*—Frank E. Werner

*Attorney, Agent, or Firm*—Ross, Howison, Clapp & Korn

[57] ABSTRACT

A liner installation device includes a liner (16) for being disposed in a container (10). A manifold (24) is operable to be disposed at the peripheral opening of the container (10) and be connected to a vacuum source (22) through a hose (26). After the liner (16) is disposed in the container (10), the peripheral edges thereof are held against the peripheral edges of the container (10). A vacuum is pulled on the space between the interior surfaces of the container (10) and the exterior surfaces of the liner (16).

15 Claims, 3 Drawing Sheets

VACUUM APPARATUS FOR INSTALLING A WATER PROOF LINER

CROSS REFERENCE TO RELATED APPLICATIONS

This application is a continuation of patent application Ser. No. 241,770, filed Sept. 7, 1988, which is a continuation of patent application Ser. No. 863,093, filed May 14, 1986, now abandoned, which is a continuation-in-part of patent application Ser. No. 733,962, now U.S. Pat. No. 4,671,733, issued June 9, 1987, which is a continuation-in-part of patent application Ser. No. 502,696, now U.S. Pat. No. 4,516,906 issued on May 14, 1985.

TECHNICAL FIELD OF THE INVENTION

The present invention pertains in general to waterproof liner installation systems for cargo containers and, more particularly, to a liner installation system utilizing only vacuum.

BACKGROUND OF THE INVENTION

The basic concept of providing a semi-truck trailer with a liner and ancillary support equipment has been generally proposed in the past for various reasons. For example, in U.S. Pat. No. 2,712,797 a bag like flexible container is disclosed mounted in a dump truck trailer wherein supporting means for collapsing the flexible container is provided such that the trailer can be used for bulk haulage of pourable material as well as for general hauling. U.S. Pat. No. 3,756,469 discloses a flexible liner used in a hopper vehicle, again where the flexible liner is supported within the trailer such that it is collapsible, allowing the trailer to be converted to general hauling. Other specialized applications for open topped trailer liners have been proposed such as in U.S. Pat. No. 4,186,845 wherein a foamed base sheet with polymeric top sheet is proposed for creating a tub within a trailer and U.S. Pat. Nos. 3,980,196 and 4,124,136 disclose flexible liners with framework and bulk head that essentially convert the trailer into a container for bulk cargo transport. Similarly, U.S. Pat. No. 3,951,287 discloses a flexible liner that is supported within a conventional semi-trailer by stretchable connectors along the trailer sidewalls that essentially convert the trailer to bulk material shipping.

In contrast to the prior art concept of using a flexible liner for bulk handling, theoretically there are other applications for use of a liner within a trailer provided such liner would be intrinsically extremely inexpensive, be readily and conveniently installed without essentially any down time or significant additional labor costs and provided that no other significant health hazard or risk is associated with its use. For example, it is known and generally tolerated in the trailer industry that certain types of common and ordinary goods statistically incur significant water damage associated with conventional transportation procedures independent of continuing efforts to prevent such shipping damage. In particular, moisture damage to cigarette and other tobacco products during transportation is known to be a troublesome problem in the industry, as is moisture and water damage to various paper products and paper related articles directly attributable to leaks in the semi-trailer. Although damages associated with such occurrences can be considered a significant statistical risk and cost from an insurance industry viewpoint, the actual effectiveness of correcting the problem by conventional methods (e.g., better packaging, sealing leaks in the trailer, etc.) is cost prohibitive relative to insuring the risk. In principle, an essentially disposable liner that could be selectively installed in a semi-trailer on an as needed basis would represent an ideal solution. To the best of the present inventor's knowledge, no one has proposed a method of installing an essentially stand-alone, disposable polyolefin film bag that could be installed in a semi-trailer on short notice and enclose the entire cargo.

SUMMARY OF THE INVENTION

The present invention disclosed and claimed herein comprises an apparatus for installing a disposable liner within a cargo container. The apparatus includes a cargo container having an opening and interior sides therefor. A cylindrical shaped bag open at one end is disposed within the container and the peripheral edges thereof attached to the peripheral edges of the opening in the container. The space that exists between the sides of the bag and the inner sides of the container is connected to a vacuum source and a vacuum drawn thereon such that the sides of the bag are drawn toward the inner sides of the container. The vacuum is maintained until cargo is loaded into the bag and then the vacuum is removed. After removal of the vacuum, the peripheral edges of the bag opening are removed from the peripheral edges of the opening in the container and the bag closed to seal the cargo.

BRIEF DESCRIPTION OF THE DRAWINGS

For a more complete understanding of the present invention and the advantages thereof, reference is now made in the following description taken in conjunction with the accompanying Drawings in which.

DETAILED DESCRIPTION OF THE INVENTION

Figure 1:
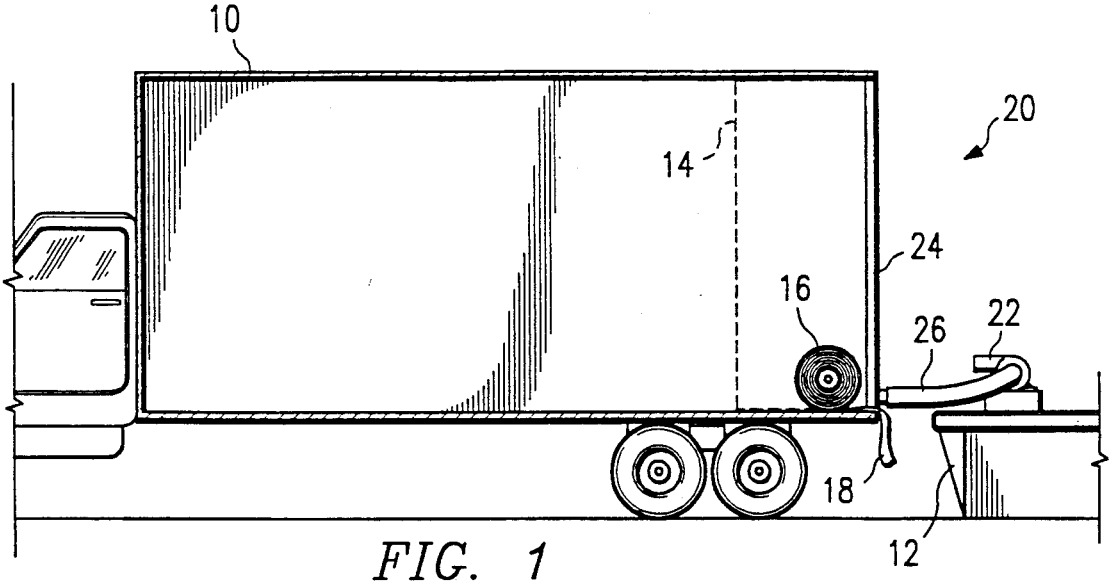
FIGS. 1 through 3 illustrate partial cross-sectional views illustrating the sequential steps associated with the method of the present invention for placing a stand-alone, moisture proof liner in a semi-trailer.

The method of installing a waterproof liner according to the present invention can perhaps be best explained and understood by reference to the drawings. FIG. 1 illustrates a conventional semi-tractor trailer 10 backed up to a loading dock 12 with rear doors 14 of the trailer 10 opened for installation of the liner 16. As illustrated, liner 16 is initially in a deflated state and, in this embodiment, rolled up in a tight coil. The liner 16 is essentially a large plastic bag or inflatable bladder wherein the opening 18 of the liner is positioned at the doorway 20 of the trailer. The liner is then unrolled or unfolded and stretched out such that it extends along the floor of the trailer and the open end of the bag extending out the doorway. An air blower 22 is positioned on the dock 12 and directed toward the back of the trailer 10 such as to be turned on late when inflating the liner 16.

Figure 7:
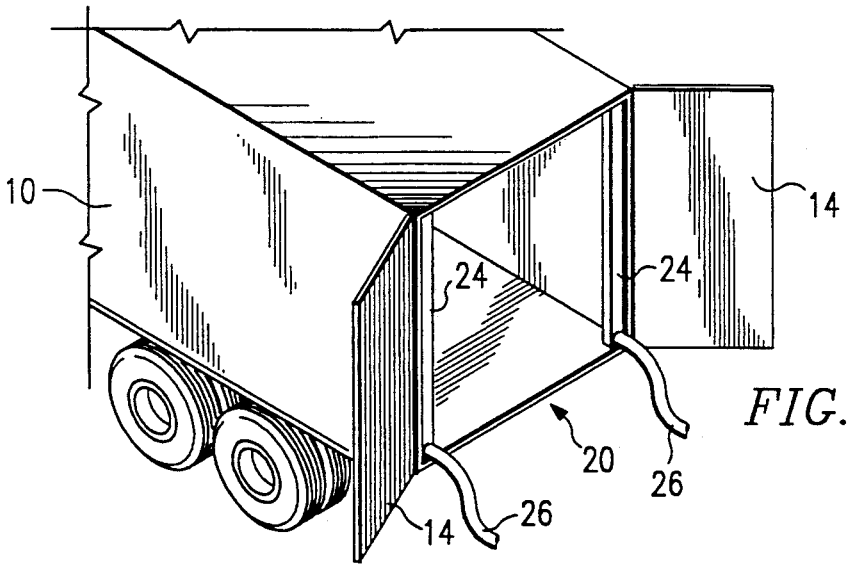
FIG. 7 illustrates vacuum assist equipment installed in a semi-trailer before inflation of the liner.

Also, a pair of vertical vacuum tubes 24 (see FIG. 7) are inserted on the interior of the sidewalls at the rear of the semi-trailer near the hinged portion of the door 14. Each of the vacuum tubes 24 are connected via flexible hoses 26 to the suction side of blower 22. It should be appreciated that other physical configurations, equipment and methods of applying suction to the interior of the trailer or cargo container between the plastic liner and the container sidewalls can be employed in the present invention. As such, various suction tubes or other air channels can be readily incorporated into the present invention, including by way of example, but not limited thereto, horizontal tubes extending from the door of the trailer back into the rear of the container, air channels built into the sidewalls of the cargo container or trailer, horizontal suction tubes along the top and/or bottom of the doorway, and the like. It should be further appreciated that the vacuum tubes 24 of the drawing as well as any equivalent structure according to the present invention should be perforated (not shown) along the device such as to withdraw air potentially trapped between the expanding plastic liner and the sidewalls confining the liner.

Figure 2:
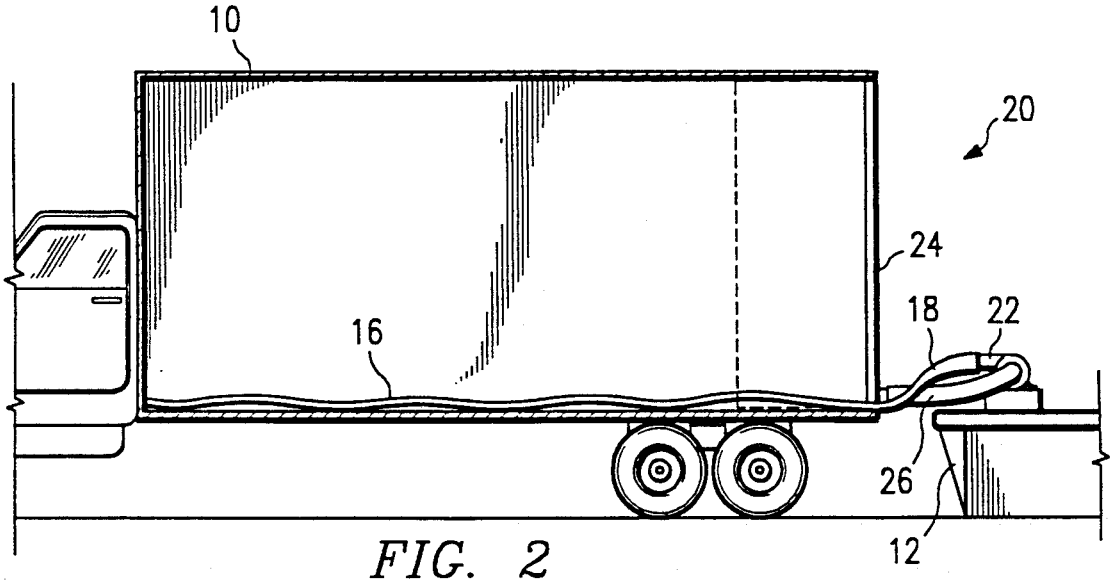

FIG. 2 illustrates liner 16 fully extended in the trailer 10 with the liner opening 18 being mounted directly to the air outlet side of the blower 22. Various alternative methods of attaching the liner 16 to the air supply can be employed. Thus, the opening 18 can be connected directly to the blower outlet as illustrated or can be attached to various types of nozzles, connectors or the like which in turn are fed air from a blower, air manifold or even compressed gas cylinder or other equivalent source. Similarly, it is envisioned that the vacuum tubes 24 can be physically attached through various types of nozzles, connectors, or the like, to any appropriate vacuum source, including the inlet side of the blower, or other equivalent low pressure device or equipment.

Figure 3:
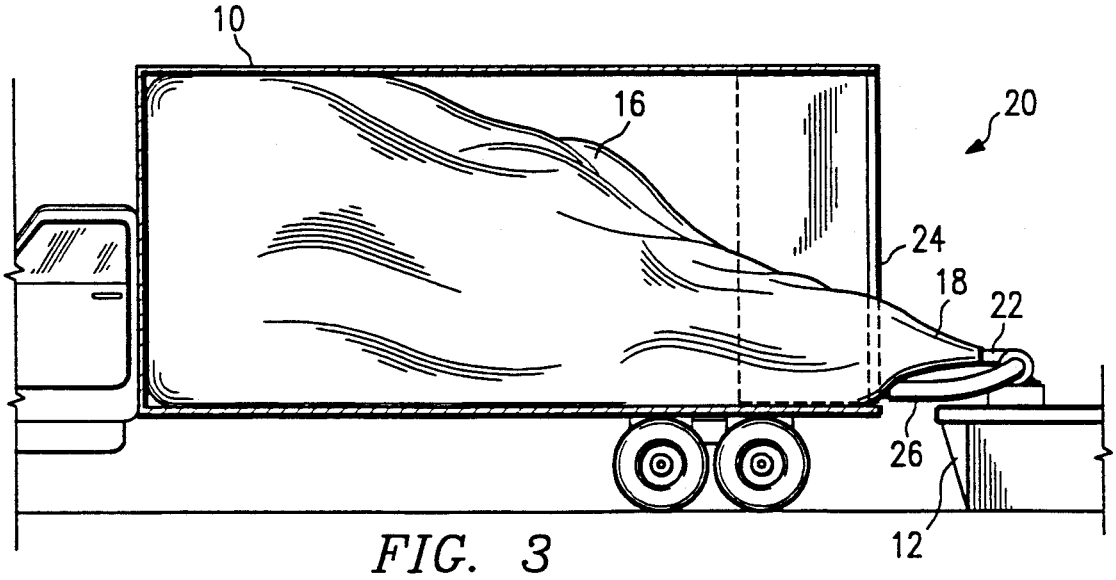

Having secured the opening 18 of the liner 16 to the blower 22, the blower 22 is then turned on and gentle stream of air is directed into the liner 16. The air is selectively directed to the front of the trailer 10 (see FIG. 3) such that the liner 16 inflates to the ceiling of the trailer in the front portion of the trailer first. The blower 22 continues to gradually fill the liner 16 from the front of the trailer to the rear of the trailer. To assist in this critical inflation step, tension can be selectively applied to the upper surface of the liner 16 by manually pulling downward and outward on the upper edge of the liner opening 18, if necessary. Experience indicates that if the liner 16 is not inflated from the front to the rear, thus systematically displacing any trapped air behind the bag, the entire liner 16 will tend to exit the trailer during the inflation step. Experience further indicates that when applying sufficient suction to the region between the liner 16 and the confining sidewalls as the liner 16 inflates, the tendency of the liner 16 inside the trailer to be forced out of the trailer is significantly reduced.

In view of the above step, it is also critical that the dimensions of the liner 16 be selected such that it will fit the entire interior of the trailer. Preferably, the liner 16 is a cylindrically shaped bladder having a diameter slightly greater than the larger of the width or height of the inside of the trailer.

Figure 4:
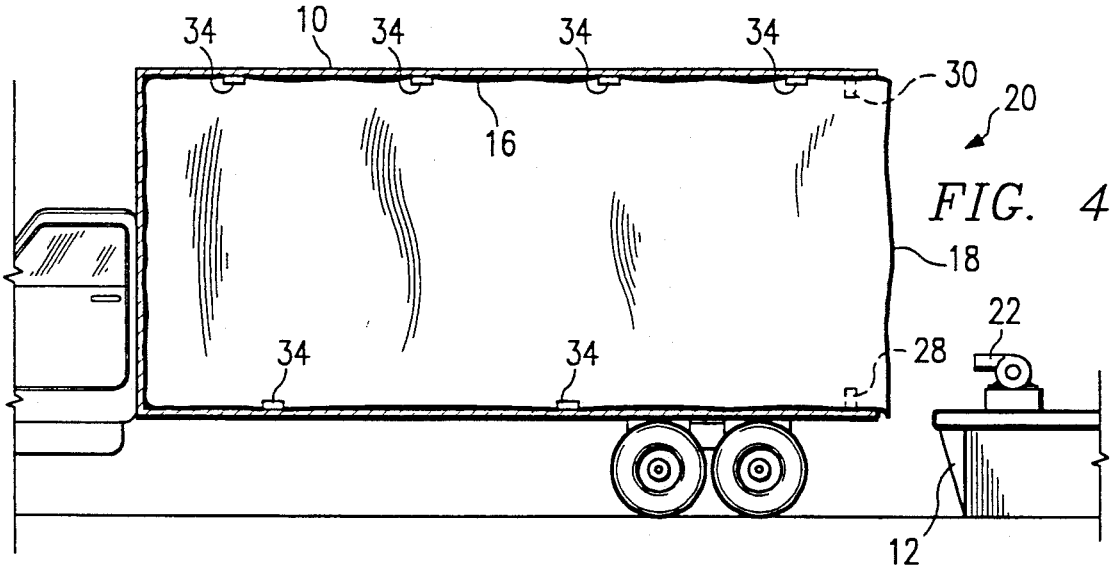
FIGS. 4 and 5 illustrate the free standing waterproof liner fully installed and ready for loading of the trailer.
Figure 5:
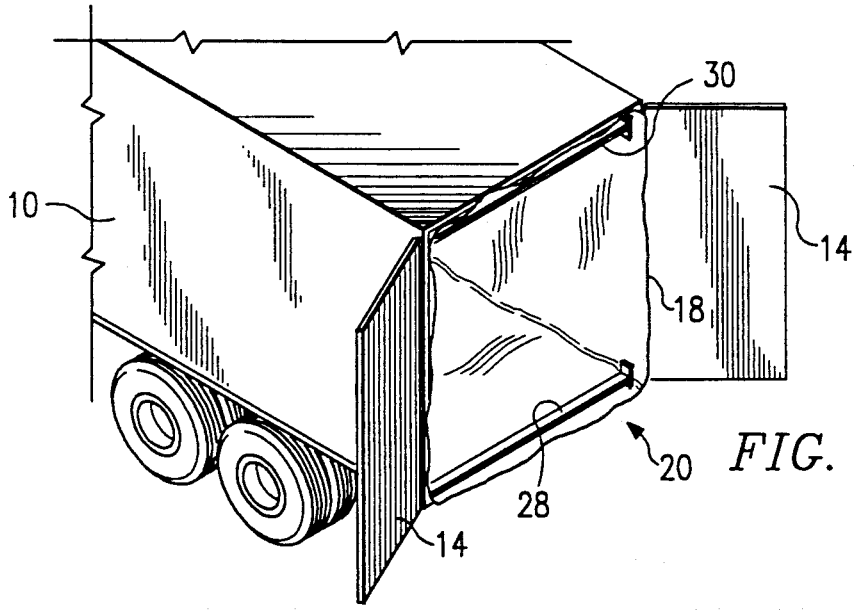
Figure 6:
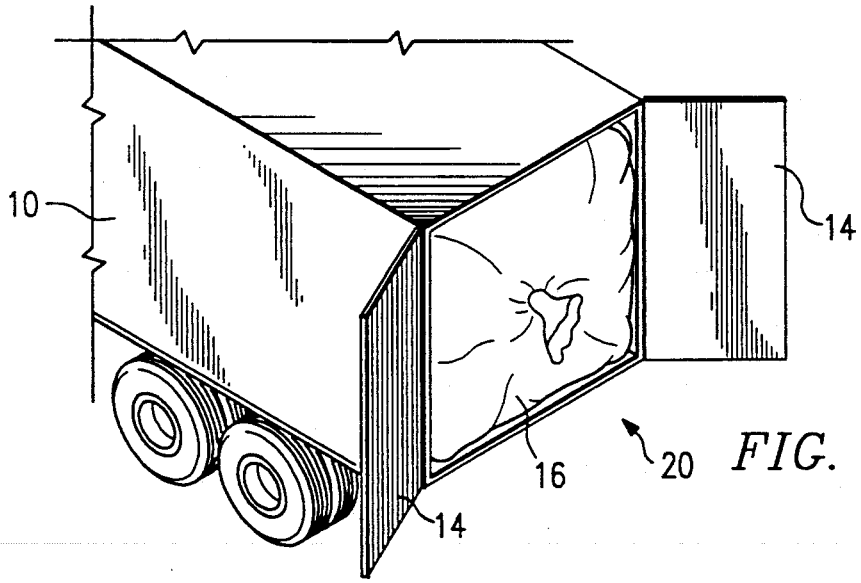
FIG. 6 illustrates the moisture proof liner sealed around the cargo of a loaded trailer.

As illustrated in FIGS. 4 and 5, once the liner 16 is fully inflated, the opening 18 can be removed from the air source and the liner 16 can be attached to the perimeter of the trailer doorway 20. In the specific embodiments of the drawing, the tension bars 28 and 30 are used to temporarily seal the bag opening 18 at the trailer doorway 20. Continued application of suction is an acceptable alternative to the use of tension bars. Also, any temporary sealing or fastening means or method well known in the art can be employed to temporarily attach the liner 16 to the doorway. The trailer is now ready to be loaded in a conventional manner. During loading, the blower may also remain in operation. However, the liner 16 once correctly inflated and sealed at the trailer doorway tends to remain in an inflated state for a considerable period of time, even without air or suction assist. After loading the cargo into the trailer, the blower is turned off and the excess liner material is wrapped around the end of the cargo and sealed such as to insure a moisture proof enclosure surrounding the entire cargo (see FIG. 6).

As previously stated, the liner 16 or inflatable protective bladder of the present invention is preferably a thin polymeric film bag of sufficient size to make contact upon inflation with the entire interior of the enclosure. It is contemplated that the liner 16 can be made of any of the conventional film grade polymeric compositions, including by way of example, but not limited thereto, polyolefins such as high density polyethylene, low density polyethylene, polypropylene and blends thereof, film grade vinyl polymers as well as natural polymeric materials such as cellulose type film. The class of polymeric film compositions that has been found to be particularly useful in the manufacturing of the plastic liner are the film grade blends of high density polyethylene with low density polyethylene. The liner 16 is contemplated as being capable of being fabricated from a series of polymeric strips or sheets which are adhesively bonded or heat sealed along longitudinal seams to each other to form the liner 16. The liner 16 can also be extruded in a single sheet or cylindrical tube provided an extrusion dye of sufficient size is available. If longitudinal pieces are to be sealed together to make the bag, the use of a thicker film for the floor, along with color pigmentation and non-slip additives to identify the floor versus the sidewalls can be incorporated into the construction of the liner 16. Experience indicates that when polyolefins such as polyethylene blends are used, the liner 16 can be made out of a relatively thin film. A 2-mil polyethylene film has been successfully tested under conventional interstate commerce transportation conditions and has proved to be quite adequate for purposes of this invention. In fact, such liners have exhibited the ability to be reused if desired, but the inexpensive nature of the thin film would not necessitate reuse and is highly suggestive of disposing of the liner after one shipment.

The actual time, effort and equipment employed to install the liner is surprising nominal. Under conventional semi-trailer dock loading procedures and environment, the time required to actually inflate the liner 16 has been measured to be as short as 30 seconds. The procedure employed during this observation was essentially as illustrated in the drawing and involved air movement equivalent to that produced by a conventional air blower or air fan.

The use of polyolefin film liners of the present invention is particularly useful to protect tobacco products, paper products, foods and drugs, as well as other highly moisture sensitive cargo. The liners are also useful in shipping cargo that require ultra clean or an uncontaminated environment and could also be readily adapted to be used to maintain an inert vapor phase or gaseous environment. It is envisioned that the method of installing the film liner can be advantageously employed in semi-trailers, cargo containers or generally any equivalent transportation or storage facility wherein an inexpensive, throw-away plastic liner would be appropriate.

Figure 8:
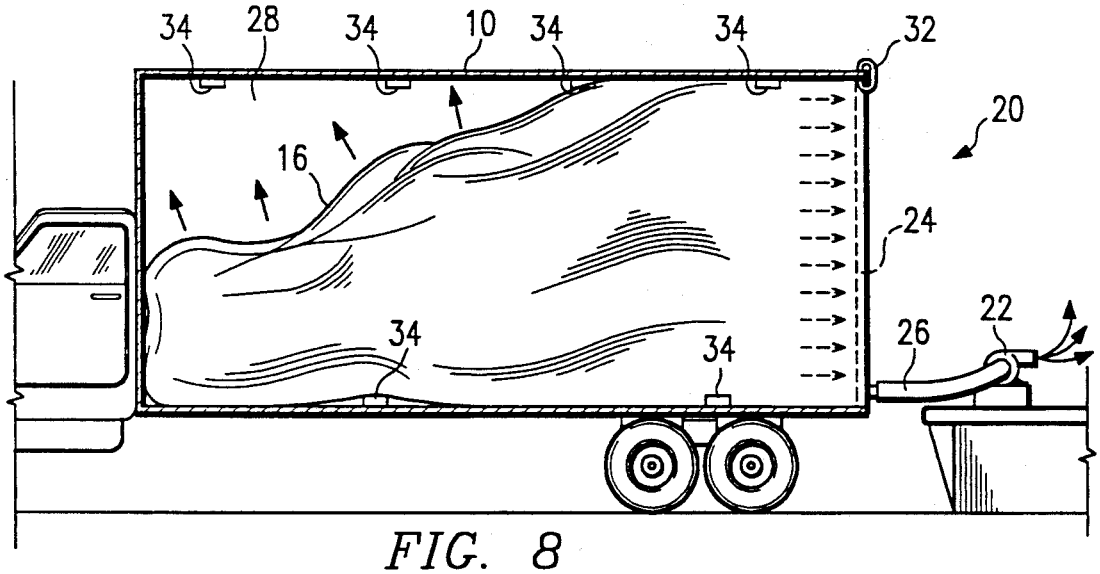
FIG. 8 illustrates the method of the present invention utilizing only vacuum assist inflation of the liner.

Referring now to FIG. 8, there is illustrated an alternate method for practicing the invention. The blower 22 is operated such that it only draws a vacuum through hose 26 from the vacuum tubes 24. These vacuum tubes 24 in the preferred embodiment draw a vacuum along the sides of the interior of the trailer to evacuate a space 28 between the bag 16 and the trailer body 10. The trailer body 10 is essentially a semi-sealed enclosure such that a negative pressure is created in space 28 when a vacuum is drawn through hose 26 by blower 22. The vacuum or negative pressure in space 28 causes the bag 16 and the surfaces thereof to raise upward against the sides of the trailer body 10 due to atmospheric pressure existing on the interior of the bag 16. In order to provide a sufficient seal for space 28, the edges of the bag 16 proximate to the periphery of the trailer are attached by clamps 32 to the edge of the trailer. The clamps are any type of C-type clamp which can grip the edge of the peripheral rim of the trailer.

In operation, the bag is first laid out in the conventional manner, as described above, in the trailer and then the peripheral edge at the opening of the bag is attached to the peripheral edge of the trailer opening. These edges are then clamped to provide a seal and then the blower 22 is turned on to produce a negative pressure in space 28. This causes the sides of the bag 16 to rise upward against the inside surfaces of the tailer body 10. However, it is not necessary for the bag to actually touch all sides of the trailer. It is therefore unnecessary to have the air blowing in the interior of the bag to create a positive pressure on the inner surfaces and therefore, the operation is significantly simplified.

Although the preferred embodiment has been described in detail, it should be understood that various changes, substitutions and alterations can be made therein without departing from the spirit and scope of the invention as defined by the appended claims.

What is claimed is:

1. An apparatus for installing a liner proximate to the interior walls of a container, the container having at least one opening and the liner having at least one opening, comprising:

a sealing device for releasably attaching at least a portion of the peripheral edge of the opening of the liner to the peripheral edge of the opening of the container such that the peripheral edge of the liner will form a substantially airtight seal therewith when a negative air pressure is disposed between the liner and the interior walls of the container to prevent air from moving from the exterior of the container to an intermediate space that is defined between the interior walls of the container and the exterior surface of the liner; and a vacuum device disposed proximate to the peripheral edge of the opening of the liner for creating a vacuum between the interior surfaces of the container and the exterior surfaces of the liner by continuously drawing air outward between the peripheral edge of the opening of the liner and the peripheral edge of the opening of the container to cause the walls of the liner to move toward the interior walls of the container and substantially reduce the volume of said intermediate space.

2. The apparatus of claim 1 wherein said vacuum device comprises:

a vacuum manifold for being disposed proximate to the peripheral edge of the opening of the liner and between at least a portion of the interior walls of the container and the exterior surface of the liner to provide an air-flow path from said intermediate space to the exterior of the container between the peripheral edge of the opening of the liner and the peripheral edge of the opening of the container; and a blower device for causing an outward flow of air through said vacuum manifold.

3. The apparatus of claim 2 wherein said blower device comprises:

a blower having an inlet and an outlet, said blower operable to create a low pressure on the inlet thereof; and a conduit device for connecting the inlet of said blower to said vacuum manifold, said vacuum manifold having an outlet, wherein air flows from the outlet of said vacuum manifold to the inlet of said blower, said blower operable to be placed at a point remote from said vacuum manifold.

4. The apparatus of claim 2 wherein said vacuum manifold is operable to be disposed proximate to the peripheral edge of the container opening on the inner side thereof, on at least a portion thereof with a seal being formed between the peripheral edge of container, said vacuum manifold, and the peripheral edge of the opening of the liner.

5. The apparatus of claim 4 wherein said manifold device comprises an elongated and hollow member having an exterior surface and an interior surface, the exterior surface having an outlet opening for connection with said blower device, and said interior surface having a plurality of perforations disposed over a large area, for providing an air inlet, said elongated member operable to extend substantially from the bottom of the peripheral opening of the container to the top thereof wherein the container opening is rectangular shaped.

6. The apparatus of claim 1 and further comprising a positive pressure device for creating a positive pressure in the interior of the liner to assist in forcing the liner outward.

7. The apparatus of claim 6 wherein said positive pressure device creates a turbulent air flow in the interior surface of the liner.

8. The apparatus of claim 6 wherein said positive pressure device comprises a blower mounted proximate to the container opening and having an outlet for creating a high pressure area such that air is directed into the interior of the liner to create a positive pressure therein.

9. A liner installation apparatus, comprising:

a cargo container having a hollow interior and at least one opening;

a liner having a shape substantially similar to the interior of said cargo container and having at least one open end for loading of cargo therein;

attachment means for attaching at least a portion of the peripheral edges of the opening of said liner to the peripheral edges of the opening in said container to substantially seal the interior cavity formed between the interior surfaces of said container and the exterior surfaces of said liner when negative pressure is disposed between the liner and the interior walls of said container;

an interface device disposed between the peripheral edges of the opening in said liner and the peripheral edges of the opening in said container and for communicating with the interior cavity formed by the interior surfaces of said container and the exterior surfaces of said liner, said interface device having an inlet for receiving air and in direct contact with the interior cavity, and an outlet for expelling air to the exterior of said container;

a vacuum source for generating a negative pressure relative to the atmosphere exterior to said container, said vacuum source having an inlet for receiving air therein; and conduit means for connecting the outlet of said interface device and the inlet to said vacuum source.

10. The apparatus of claim 9 wherein said cargo container is polygonal in shape with substantially rectangular sides, with at least one of said sides comprising at least one opening, one of said sides adjacent to at least one opening being substantially horizontal to allow loading from a horizontal platform therein.

11. The apparatus of claim 9 wherein said liner is substantially moisture proof.

12. The apparatus of claim 9 wherein said attachment means comprises clips for removably attaching selected points on the peripheral edges of the opening of said liner to selected points on the peripheral edges of the opening of said container such that each of said clips contacts the outer surface of said container and the inner surface of said liner proximate to the peripheral edges of the openings thereof.

13. The apparatus of claim 9 wherein said interface device comprises a manifold having a hollow interior with one surface comprising an exterior surface and one surface comprising an interior surface, said manifold positioned proximate to the peripheral edges of the opening of said container and releasably attached thereto, the interior surface of said manifold having a plurality of openings formed therein and communicating with the interior surface, the exterior surface of said manifold having at least a portion thereof in communication with the exterior of said container with an opening formed therein, said opening comprising the outlet of said interface device.

14. The apparatus of claim 9 wherein said inlet is comprised of a predefined surface area with a plurality of holes dispersed therethrough such that the air flow is dispersed over a large surface area.

15. The apparatus of claim 9 wherein said vacuum source is disposed remotely from said container and said connection device comprises a hose connected on one side to the outlet of said interface device and at the other side thereof to the inlet of said vacuum source.

* * * * *